United States Patent [19]

Pernick et al.

[11] Patent Number: 4,839,002

[45] Date of Patent: Jun. 13, 1989

[54] METHOD AND CAPACITIVE DISCHARGE APPARATUS FOR ALUMINUM ANODIZING

[75] Inventors: Jeffrey R. Pernick, Union Lake; Frederick Tourtellotte, Birmingham, both of Mich.

[73] Assignee: International Hardcoat, Inc., Detroit, Mich.

[21] Appl. No.: 137,516

[22] Filed: Dec. 23, 1987

[51] Int. Cl.[4] ..... C25D 11/04; C25D 17/00

[52] U.S. Cl. ..... 204/58; 204/228

[58] Field of Search ..... 204/228, 58

[56] References Cited

U.S. PATENT DOCUMENTS

| | | | |
|---|---|---|---|
| 3,418,222 | 12/1968 | Schaedel | 204/228 X |
| 3,597,339 | 8/1971 | Newman et al. | 204/228 X |
| 3,708,407 | 9/1968 | Newman et al. | 204/228 X |
| 3,975,254 | 8/1976 | Elco et al. | 204/228 |
| 3,983,014 | 9/1976 | Newman et al. | 204/228 X |
| 4,026,781 | 5/1977 | Newman et al. | 204/228 |
| 4,478,689 | 10/1984 | Loch | 204/228 X |
| 4,517,059 | 5/1985 | Loch | 204/228 X |

OTHER PUBLICATIONS

U.S. patent application Ser. No. 943,510 filed Dec. 19, 1986 and entitled "LVA Anodizing Process, Apparatus & Product".

*Primary Examiner*—Donald R. Valentine

*Attorney, Agent, or Firm*—Dykema Gossett

[57] ABSTRACT

An improved electrical power control apparatus and method for use in an aluminum anodizing system includes a pulsed DC power supply and an automatic switchable shunt discharge unit connected in parallel across the anodizing cell. The cell, consisting of an anode, the aluminum part or workpiece being anodized, the electrolyte bath of sulfuric acid or the like and the cathode, forms and inherent capacitance that retains charge when pulsed with positive current flowing into the workpiece through the anode from the power supply. Between positive current pulses produced by peridoic firing of the SCRs in the power supply, the automatic discharge unit shunts the accumulated charge from the anode to cathode, thereby discharging the inherent capacitance. This markedly lowers average DC processing voltages, reduces the chance of damage to the workpiece due to overvoltage, reduces processing time, and can improve the quality of the anodized coating. The timing of the discharge is controlled automatically by control circuitry which monitors the positve current from the power supply with electrically isolated magnetically coupled sensing devices such as current transformers.

14 Claims, 3 Drawing Sheets

METHOD AND CAPACITIVE DISCHARGE APPARATUS FOR ALUMINUM ANODIZING

FIELD OF THE INVENTION

This invention generally relates to systems and processes for anodizing aluminum and alloys thereof, and specifically to an electrical power control apparatus and method for aluminum anodizing systems that discharges the inherent capacitance existing between the anode and aluminum part being anodized and the electrolyte and cathode in such an anodizing system.

BACKGROUND OF THE INVENTION

In the past, there have been several problems concerning the anodizing of aluminum, particularly hard coat anodizing which conventionally has required higher processing voltages. First, the voltage required to maintain current increases as the coating of aluminum oxide builds upon the aluminum part being anodized. The final voltage required for a 0.002 inch thick coating can exceed 70 votls DC (average), which results in a very large power consumption. Second, since the electrolyte in the anodizing tank must be maintained at a constant temperature, the heat generated by the relatively high power input must be removed by large, costly refrigeration equipment which is expensive to operate from an energy standpoint. Third, the current must be built up very slowly in order to condition the part for full current density. This typically results in a 20 minute start-up period where the tank is not coating at full speed, but instead is in a ramping stage. Fourth, thick coatings are difficult to produce because above a certain thickness, the average voltage required between anode and cathode is about 70 volts DC or more. At this voltage, the amount of power going through the part being coated often makes the coating unstable and may produce rapid dissolution and burning. Also, at this point the voltage is increasing exponentially while the coating thickness is increasing linearly, resulting in excessive power use for limited incremental increases in coating thickness. Finally, anodized coatings are difficult or impossible to produce in aluminum alloy containing copper as an alloying element using most conventional processes. Attempts to coat these alloys by such processes results in burning and dissolution of the metal.

There have been several attempts to solve these problems. Both electrical and chemical modifications have been tried. The electrical modifications have involved changing the waveform from the power supply, and the two major techniques may be called the pulsed DC technique and the AC over DC technique. In the pulsed DC technique the power supply is modified to produce regularly spaced DC current pulses, with no current flowing during the time between the pulses. It is believed that the periods of time between the pulses when no current is flowing allows the part to cool, and the electrolyte to rejuvenate. Systems employing this pulsed DC technique do decrease the ramp time required, thereby promoting process efficiency, and do make it easier to process copper bearing aluminum alloys. However, although the coatings can be applied more quickly using this technique the process requires higher current so that the cost-savings achieved by increase in processing speed is offset by the added cost of increased energy consumption. In the AC over DC technique, the power supply is modified to produce a small reverse current, or negative, pulse between each forward current, or positive, pulse. These systems have helped with all of the problems, except overall energy use. However, in order to operate then successfully, it is necessary to very closely monitor the amount of reverse current applied to the workpiece, because excessive reverse current is known to damage the anodic coating being formed on the part being anodized.

Several U.S. patents describe anodizing systems and processes which utilize large positive or forward current pulses and relatively small reverse current pulses. Such systems and processes may be viewed as one form of the AC over DC technique. The following U.S. patents are included in this group of patents:

| U.S. Pat. No. | Inventor |
|---|---|
| 3,597,339 | Newman et al. |
| 3,975,254 | Elco et al. |
| 3,983,014 | Newman et al. |
| 4,517,059 | Loch et al. |

In the first three of these patents the anodizing system which is described therein used a silicon controlled rectifier (SCR) or comparable switching element connected to a transformer to generate controlled negative current pulses near the end of or in the middle of the negative-going portion of the AC waveform of the secondary of the transformer. In the fourth patent, namely U.S. Pat. No. 4,517,059, the negative current pulses are produced by connecting a negative polarity DC power supply between the part to be anodized and cathode of the system via a power drive in the form of a relay. Thus, in each of the prior art systems disclosed in these patents, the negative current flow through the part to be anodized is achieved by applying a source of negative voltage between the anode and cathode of the system.

One of the co-inventors for the present invention, working with others, developed a new power control apparatus for anodizing systems and processes which doese not require the use of a negative power supply. Instead, this new apparatus and process relies upon the retained charge present across the inherent capacitance of the anode and a part to be anodized and the electrolyte and cathode to discharge itself by providing a continuously connected shunt discharge means connected between the anode and cathode. This new system and process is described in U.S. patent application Ser. No. 943,510 filed Dec. 19, 1986 and entitled "LVA Anodizing Process, Apparatus and Product", the disclosure of which is hereby incorporated by reference herein. This appliation discloses that a resistive shunt discharge means and a pulsed DC power supply may be utilized to produce cyclic alternate charging and discharging cycles of the inherent capacitance formed between the anode and workpiece and the electrolyte and cathode. Moreover, the aforementioned application reports that the new apparatus and method provide significant benefits which include, among other things: (1) lower voltages being required to maintain the current needed to effect the required anodizing reactions in the bath; (2) the ability to easily form metal oxide coatings to thicknesses heretofore unachievable with conventional prior art systems; (3) the reduction of time required to anodize a part to given thickness; and (4) the ability to more closely control porosity and strength of the oxide coating produced by the anodizing process.

However, we have found that the disclosed continuous connection of a shunt discharge means permanently across the anode and cathode wastes electrical power unnecessarily, especially whenever the DC power supply system is producing positive current flow into the part to be anodized. We also realize that it would be beneficial to provide a switchable shunt discharge means, which discharge means could effectively be removed from the circuit whenever the DC power supply was attempting to provide positive current to the workpiece. With these thoughts in mind, we set out to devise a suitable fully automatic power control apparatus and method which would switch a shunt discharge means, such as a low ohmage power resistor, in and out of the overall anodizing process. Numerous problems were encountered, particularly with reliably determining under widely varying processing conditions when the positive current flow from power supply was acutally being turned on and off. Our efforts and testing over a period of months enabled us to refine our objectives to those stated below and develop the apparatus and method of the present invention described in detail below.

The principal object of the present invention is to provide an automatic power control apparatus and method for operating an aluminum anodizing system using a switchable shunt discharge means to discharge, quickly and immediately after the cessation of every charging cycle, the accumulated charge stored across the inherent capacitance existing between the anode and cathode of the system. Related objects of the present invention include: (1) fully automating this power control apparatus and method in a manner that avoids the need for expensive or complicated equipment for monitoring or controlling reverse control levels; (2) reliably detect the termination of a positive current flow to the workpiece under widely varying process conditions; (3) reliably detecting the beginning of positive current flow to the workpiece under widely varying process conditions; and (4) very quickly discharging at a optimum rate the built-up charge stored across the inherent capacitance.

SUMMARY OF THE INVENTION

In light of the foregoing problems and to fulfill the foregoing objects, there is provided, according to one aspect of the present invention, an improved electrical power control apparatus for providing positive and negative current to a workpiece in an anodizing system using an electrolyte, anode and cathode for anodizing the workpiece, which may be made of aluminum or alloy of aluminum. The improvement comprises in combination: power supply means for intermittently providing only positive current to the workpiece during the anodizing process; and automatic switchable shunt discharge means for intermittently providing negative current to the workpiece by shunting the anode to the cathode, the discharge means being arranged to produce such negative current solely by the unassisted discharge of accumulated charge present on any inherent capacitance existing between the anode and workpiece and the electrolyte and cathode. The switchable shunt discharge means of the apparatus preferably includes at least one electrical switching device switchable between a very low impedance conducting state and a high impedance non-conducting state, and control means for determining when to switch the electrical switching device between its conducting and non-conducting states based at least in part upon whether the power supply means is providing positive current to the workpiece. The control means may include: first sensing means for detecting when the power supply means is no longer providing positive current to the workpiece; second sensing means for detecting when the power supply means is beginning to provide positive current to the workpiece; memory means responsive to the first and second sensing means for remembering when the power supply means is providing positive current to the workpiece; and interlock means for switching the electrical switching device to its non-conducting state whenever the power supply means is providing positive current to the workpiece.

According to a second aspect of the invention, there is provided a method of controllably discharging any inherent capacitance existing between the anode and the workpiece being anodized in an anodizing process of the foregoing type involving the intermittent supplying of positive current from the anode into the workpiece. The method comprises the steps of: (a) providing automatic switchable shunt discharge means for intermittently providing negative current to the workpiece by shunting the anode to the cathode, and (b) detecting the cessation of positive current flow into the workpiece; and (c) immediately after detecting such cessation of the positive current flow, providing such negative current in an amount sufficient to discharge the inherent capacitance substantially completely prior to the next intermittent supplying of positive current from the anode into the workpiece. As before, the discharge means is arranged to produce such negative current solely by the unassisted discharge of accumulated charge present on the inherent capacitance. The method preferably further comprises the step of: (d) providing a current-limiting element in the shunt discharge means whose impedance is sufficiently low to permit discharging the inherent capacitance so that the voltage thereacross is reduced to no more than 2% of its original value before positive current flows into the workpiece again during the anodizing process.

One important advantage of the apparatus and method of the present invention over prior art systems which generate a negative current into the workpiece is that our apparatus and method cannot apply a harmful amount of negative current to the part, thereby damaging the part, since the negative current flow reaches zero when the inherent capacitance is fully discharged.

These and other aspects, objects and advantages of the present invention will be more fully understood from the following detailed description and appended claims, taken in conjunction with the drawings.

BRIEF DESCRIPTION OF THE DRAWINGS

In the accompanying drawings, where identical reference numerals refer to like items shown in the various figures.

DETAILED DESCRIPTION OF THE PREFERRED EMBODIMENTS

Figure 1:
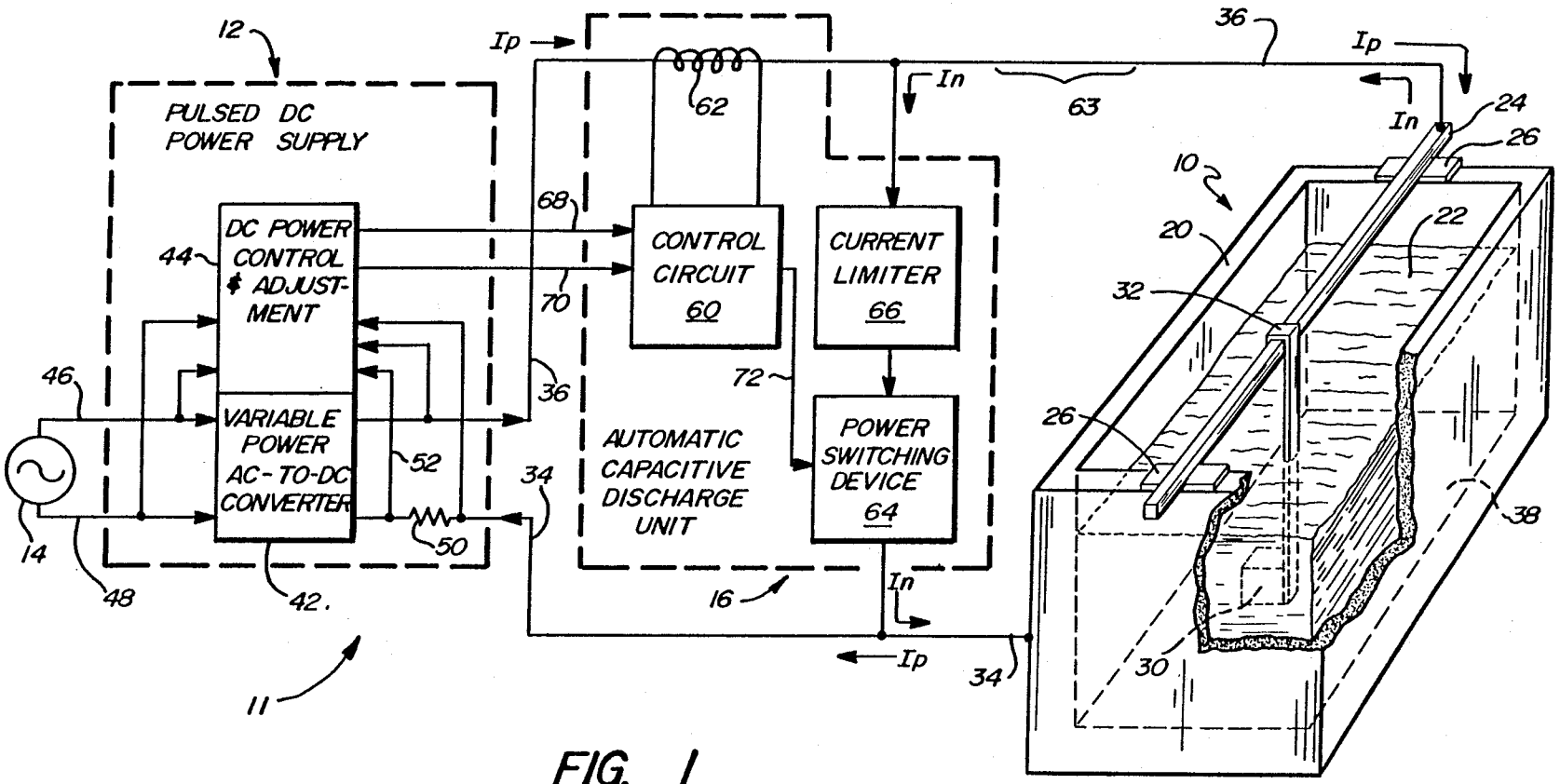
FIG. 1 is a combination perspective view of a representative aluminum anodizing system with a workpiece or part to be anodized suspended in the electrolyte within a tank, and a block diagram of an electrical power control apparatus of the present invention including a switchable shunt discharge means.

Referring to FIG. 1 there is shown a conventional aluminum anodizing call 10 and an electrical power control apparatus 11 of the present invention. The apparatus 11 includes a conventional pulsed DC power supply unit 12 powered by a conventional source 14 of AC electrical power, and an automatic capacitive discharge control unit 16 electrically connected together and to the anodizing cell 10 as shown. The AC source 14 preferably has a line frequency of 50 Hz to 60 Hz. The aluminum anodizing cell 10 includes a lead-lined metal tank 20 filled with a suitable electrolyte 22, an anode bus bar 24 electrically insulated from the tank by dielectric spacers or insulators 26, and a part of workpiece 30 to be anodized suspended in the electrolyte bath using a conventional hanger 32. And the metal tank 20 is preferably maintained at ground potential and serves as the negative terminal or cathode of the anodizing cell 10. An electrical conductor 34 is electrically connected to the tank 20 and a second electrical conductor 36 is electrically connected to the anode bar 24. The anode bar 24 provides the positive terminal of the anodizing cell. A good conductive path for the flow of heavy currents to the part 30 through the electrolyte is assured by using suitable means, for example, clamps (not shown) and/or other conventional techniques to provide electrical contacts between the anode bar 24, hanger 32 and workpiece 30 which have very low resistance. The liquid bath of electrolyte 22 may be agitated using filtered compressed air introduced into a conventional perforated manifold structure (not shown) at or near the bottom 38 of the tank so that agitation is achieved by such air bubbling up through the bath. The bath is preferably also refrigerated using conventional refrigeration means (not shown) when hard-coat processing most aluminum alloys, such as 1100, 5005, or 6061 aluminum alloys The pulsed DC power supply 12 may be of any conventional or suitable type. The such supplies typically include a variable power AC-to-DC converter section 42, and a DC power control and adjustment section 44 which contains one or more potentiometers or other conventional adjustment means (not shown) by which the operator may specify the desired power settings to be produced by the converter 42. The AC power is input over conductors 46 and 48 converted to pulsed DC power by the converter 42 and supplied to the anodizing cell 10 by conductors 34 and 36. A very low resistance shunt 50 may be provided in one of the power lines 34 or 36 to enable the DC power control section 44 to monitor the current flowing therethrough via conductors 34 and 52.

The capacitive discharge control unit 16 preferably includes a sensing control circuit 60, a power switching device 64 and current limiter 66, all connected together as shown. The sensing circuit 60 preferably includes an electrically isolated current sensing device 62 for monitoring current flowing through power conductor 36. If desired, the sensing device 62 may be arranged to sense the current flowing through conductor 36 at the location indicated by reference numeral 63. The sensing circuit 60 monitors the starting of the positive current pulses from the converter 42 through conductor 36 to the anode bus bar 24 and workpiece 30 by current signals received over conductors 68 and 70 from the DC power controller 44, and monitors the termination of the positive current pulses via current sensor 62. The sensing circuit 60 via command signals sent over signal path 72 causes the power switching device 64 to turn off as a positive current pulse begins and to turn on when that positive current pulse ends. The series combination of the power switching device 64 and the current limiter 66 are connected electrically across the anodizing cell 10. The arrows $I_P$ help indicate the path of the positive current flow, while the arrows $I_N$ help indicate the path of negative current flow. The negative current flow is produced when the stored charge present on the inherent capacitance of the anodized cell 10 is given an opportunity to discharge through the power switching device 64 and current limiting device 66, by placing the power switching device 64 in its conducting state. Whenever positive current is being produced by the pulsed DC power supply 12, the sensing circuit 60 switches the power switching device 64 to its off or non-conducting state, thereby preventing the positive current flow $I_P$ from being shunted around the anodizing cell 10 by the automatic capacitive discharge control unit 16. Note that the negative current flow $I_N$ does not pass through the pulsed power supply 12.

Figure 2:
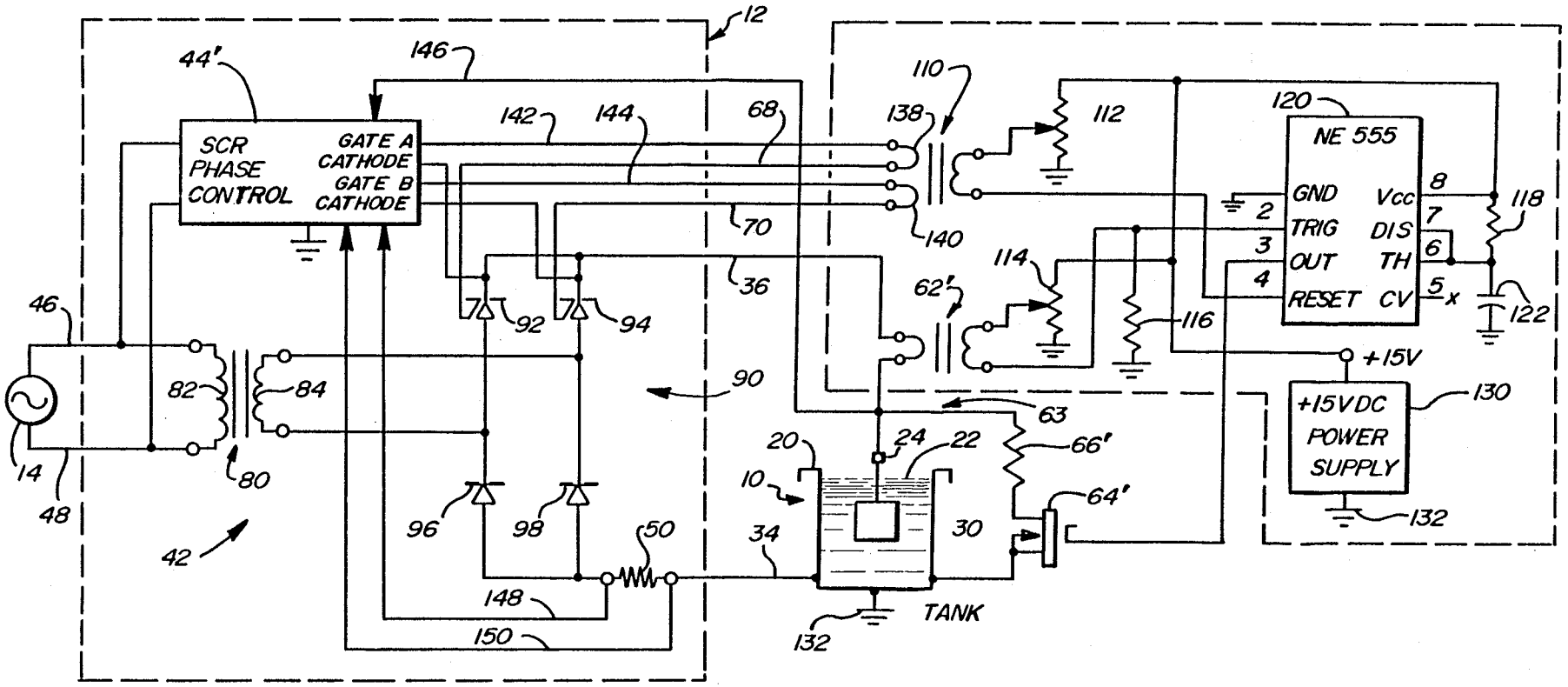
FIG. 2 is a detailed schematic diagram illustrating a preferred embodiment of the power control apparatus of the present invention.

FIG. 2 is an electrical schematic diagram illustrating a presently preferred circuit arrangement of the power control apparatus 11 of the present invention. The DC power supply 12 is generally indicated by the dashed rectangle on the left-hand side of FIG. 2. The variable power AC-to-DC converter section 42 is comprised of an isolation transformer 80 having a primary winding 82 and a secondary winding 84, and a full wave bridge rectifier circuit 90 including silicon controlled rectifiers(SCRs) 92 and 94 and bridge rectifiers 96 and 98. The firing of the SCRs 92 and 94 is controlled by the DC power controller 44, which as shown is preferably a conventional single-phase SCR control module 44'.

The components of sensing control circuit 60 are shown within dashed lines on the right-hand side of FIG. 2 and include the current sensor 62 which is preferably a small, easily-saturated current transformer indicated by the reference numeral 62', a second small, easily-saturated current transformer 110, potentiometers 112 and 114, resistors 116 and 118, memory and timer module 120, and a capacitor 122, all connected as shown. The memory and timer module 120 is preferably a standard National Semiconductor NE555 integrated circuit timer, which as is well known, can be connected to serve as a memory or latch in addition to performing a timing function.

Also shown in FIG. 2 is a schematic representation of the tank 20 filled with electrolyte 22 with the workpiece 30 to be anodized suspended therein. The power switching device 64 is preferably a power FET(field effect transistor) which is indicated by the reference numeral 64'. The current limiting device 66 is preferably a very low ohmage resistor indicated by reference numeral 66'. A conventional regulated DC power supply such as +15 VDC power supply 130 connected to ground 132 provides the necessary regulated DC voltage required for the operation of the sensing circuit 60. Conventional devices (not shown) and techniques for suppressing electrical noise and for protecting solid-state or other circuit components from transient overvoltages and/or overcurrents may also be used in the circuit of FIG. 2 if desired.

Table 1 below lists typical components used in our test set-up of the power control apparatus 11 shown in FIG. 2.

| Ref. No. | Description |
|---|---|
| 44' | SCR Phase Controller Model No. SCRT M-60-3 from Rapid Electric Co. of Brookfield, Connecticut |
| 50 | 100 mV 100 amps, current shunt |
| 62', 110 | current transformer, Model No. 1 from Omni Research Co. of Birmingham, Michigan |
| 64' | Power FET, 100 volt, 19 amp, Model No. BUZ-21 from Siemens |
| 66' | power resistor, wire-wound, 4 ohm, 100 watt |
| 80 | isolation transformer, 460 volt primary, 120 volt secondary, 15 KVA power rating |
| 92, 94 | silicon controlled rectifier, 100 amp |
| 96, 98 | power rectifier, 100 amp |
| 112, 114 | potentiometer, 10 K ohms, 0.25 watt |
| 116 | resistor, 680 ohms, 0.25 watt |
| 118 | resistor, 62 K ohms, 0.25 watt |
| 120 | NE 555 IC timing chip, Model No. LM 555 from National Semiconductor Corp. |
| 122 | capacitor, 0.22 microfarads, 30 volts |

The operation of the power control apparatus 11 shown in FIG. 2 will now be explained. As in a conventional anodizing system, the pulsed DC power supply 12 provides intermittent pulses of positive DC current over conductors 34 and 36 to the anodizing cell 10 which includes of the anode bar 24 and hanger 32, the workpiece 30, the electrolyte 22 and the tank or cathode 20. The pulses of DC current are produced by turning on SCRs 92 and 94 for a desired portion of each half cycle of the alternating current signal from the secondary winding 84 of transformer 80. Turn-on gate pulses are provided on conductors 68 and 70 respectively to trigger the SCRs 92 and 94. The conductors 68 and 70 are connected to first and second primary windings 138 and 140 of transformer 110. Gate signals to fire SCRs 92 and 94 are produced by SCR phase control 44' on conductors 142 and 144 at the appropriate time to maintain the desired average DC voltage as sensed over line 146 from the anode bus 36 or the desired DC current as sensed by DC shunt 50 and delivered to control 44' by conductors 148 and 150, in a manner well known in the art. The sensing circuit 60 monitors the current flowing through the anode bus 36 by use of transformer 62', potentiomenter 114 and resistor 116 in order to produce a negative-going turn-on trigger pulse at pin 2 of timer circuit 120 as current ceases to flow in the anode bus 36. The integrated circuit timer 120 is connected to drive the FET 64' to effect the electrical discharge of the anodizing cell immediately after the cessation of positive current flowing into the workpiece 30 of the anodizing cell during each half-cycle of the AC waveform of the supply voltages shown in FIGS. 3A and 3B.

The potentiometer 112 is a adjusted to accommodate the reset level of the timer 120 so that the turn-on gate pulses to SCRs 92 and 94 passing through the primary windings 138 and 140 of transformer 110 will cause negative going reset pulses to be delivered to pin 4 of timer 120. This in turn resets the output of timer 120 on pin 3 to a logic "zero" or low-level state such as zero volts, which in turn causes the power FET 64' to switch to its non-conducting state. This action opens the conduction path, so that no more current may flow through discharge resistor 66'.

Potentiometer 114 is adjusted to accommodate the trigger level of timer 5 so that each time the current transformer 62' comes out of saturation, as the positive current in the anode bus is terminating, a negative-going pulse is generated. This sets the output (pin 3) of timer 120 to a logic "one" or high state, which turns on power FET 64, closing the path of conduction so that negative current may flow through the current-limiting resistor 66' between the anode 24 and the cathode 20.

Resistor 118 and capacitor 122 comprise an RC timing circuit for the timer 120, and are sized to return the output of the timer 120 promptly to a logical "zero" or low state in the event that there is a loss of reset pulses from transformer 110. This may occur during start-up or shut-down of the SCR controller 44'. Preferably the resistor 118 and capacitor 122 are sized relative to the characteristics of the IC timer chip 120 to return the output to its low state when the time between sensed beginnings of successive intervals of positive current flow through the anode bus exeed a predetermined length of time at least twice as long as the period of the predetermined frequency of the AC source 14.

Figure 3A:
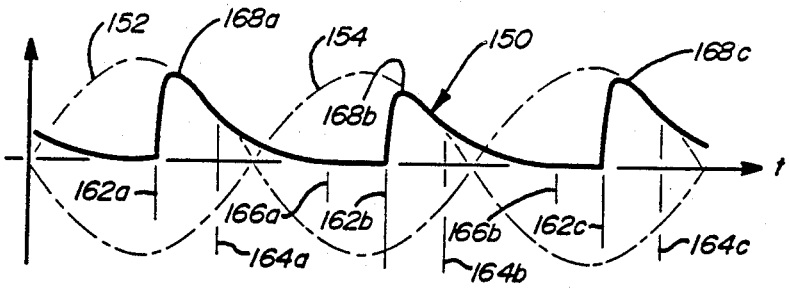
FIGS. 3A through 3F show waveforms of various electrical signals along a common horizontal time line, where time is expressed in milliseconds, with the FIGS. 3A and 3B waveforms illustrating the operation and advantages of the apparatus and method of the present invention, the FIGS. 3C and 3D waveforms illustrating the operation of a typical prior art anodizing system and process which employs a pulsed DC power supply but which does not employ negative current pulses or shunt discharge means, and the FIGS. 3E and 3F illustrating a particularly rapid capacitive discharge rate achieved by the apparatus and method of the present invention.
Figure 3B:
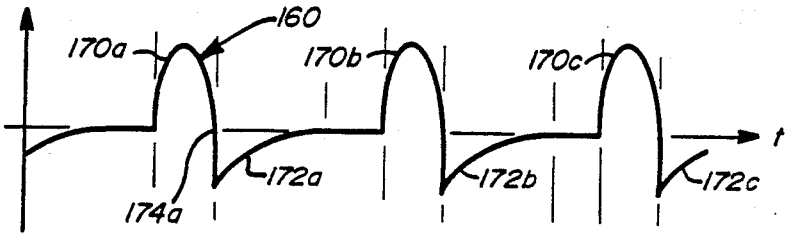

The operation of the power control apparatus 11 illustrated in FIGS. 1 and 2 may be understood by studying the waveforms shown in FIGS. 3A-3D. FIG. 3A shows the voltage waveform 150 present on the anode bus 36 for one and one-half periods of the 60 Hz frequency of AC power source 14. Sine wave 152 shown in dashed lines represents the reference voltage waveform at the anode of SCR 92 with respect to ground 132. Sine wave 154 shown in dashed lines is the reference voltage waveform for the anode of SCR 94 with respect to ground. Waveform 160 in FIG. 3B is a graph of the current flowing into the workpiece 30. The dashed vertical lines **162*a* and 162*c* represent the points in time at which the turn-on gate signal for SCR 92 is provided by SCR phase control 44' via conductor 142, thus permitting current to flow through SCR 92. Similarly, dashed vertical line 162*b* represents the point in time at which the turn-on gate signal for SCR 194 is provided via conductor 144, thus allowing current to flow through SCR 94. Dashed vertical lines 164*a*, 164*b* and 164*c* represent the point in time over the respective three-half cycles of power source 14 at which positive current from the SCR 92 or 94 ceases to flow into the workpiece 30. The dashed lines 166*a* and 166*b* represent the points in time during the second and third half cycles of FIG. 3A and 3B where the negative current to the workpiece has effectively decayed to zero. The decay of voltage waveform 150 from its peaks 168*a*, 168*b* and 168*c* to the points in waveform 150 corresponding to times 164*a*, 164*b* and 164*c* respectively is determined by the electrical characteristics of the DC power supply 12 and anodizing cell 10. But the decay in voltage from the points on waveform 150 corresponding to times 164*a* and 164*b* to 166*a* and 166*b* respectively is determined by the size of the tank discharge resistor 66' and the electrical characteristics of the anodizing cell, especially as influenced by the dynamic resistance of lead-lined tank 20, electrolyte 22 and aluminum workpiece 30**.

The current waveform 160 in FIG. 3B similarly consists of positive current or anodizing segments 170*a*, 170*b* and 170*c* and negative current or discharge segments 172*a*, 172*b* and 172*c*. The forward current segment 170*a* is typical can lasts from time 162*a* to time 164*a*. The power FET 64' shown in FIG. 2 is turned on by the timer 120 after the forward or positive current into the workpiece 30 has decreased to a level close to zero current such as at point 174*a*. The shape of the negative portion 172a of the current waveform 160 is characteristic of a charged capacitor being discharged suddenly by connecting a resistor across it. We have determined that the best overall anodizing results are achieved by discharging the anodizing cell substantially completely each half-cycle of the power source 14, as will be further explained below.

Figure 3C:
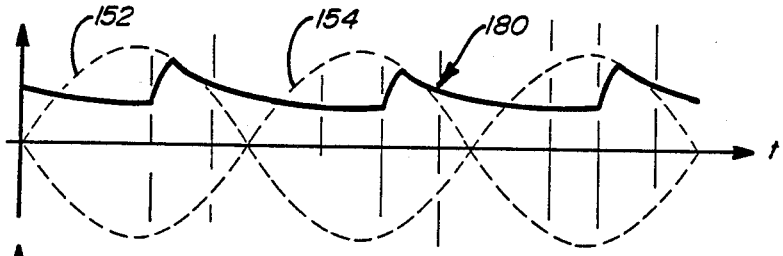
Figure 3D:
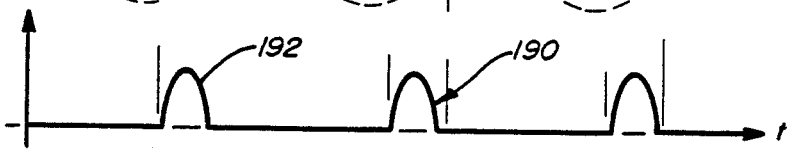

FIG. 3C and 3D show typical voltage and current waveforms 180 and 190 respectively which occur during conventional, prior art anodizing process which does not employ negative current. Waveforms 180 and 190 would be produced, for example, if automatic discharge unit 16 were disconnected from the power control apparatus 11 illustrated in FIGS. 1 and 2. Waveforms 180 and 190 are shown for comparison with the waveforms of the new and improved anodizing method of the present invention. Dashed waveforms 152 and 154, which are the voltage waveforms at the anodes of SCRs 92 and 94 respectively, are also shown in FIG. 3C for convenient reference. The waveform 180 is the characteristic voltage waveform of the typical single phase, prior art anode bus with respect to a tank which is at ground potential. This waveform 180 is also characteristic of a full wave rectifier bridge power supply charging a lightly shunted capacitor. A high average DC voltage develops between the anodic workpiece 30 and the cathodic tank 20. The anodizing cell acts as both the capacitor and the relatively higher resistance shunt resistor responsible for the gently decreasing segments of waveform 180. FIG. 3D shows the current waveform 190 of the anode bus during a conventional prior art anodizing process. The waveform segment 192 is characteristic of a positive pulse of current being fed into a capacitive load, namely the anodizing cell.

In experiments with a test set-up of the type described in FIG. 2, we have been able to successfully produce hard anodized coatings on copper-bearing aluminum alloys such as 2024 aluminum alloys. Also, we have been easily able to produce anodized coating from 10 mils (0.010 inch) to 20 mils (0.020 inch) thick or more on various aluminum alloys such as 7075-T6 aluminum alloys.

We have also found that our automated capacitive discharge process produces a very uniform and predictable rate of oxide growth under conventional controlled conditions typically maintained when anodizing most aluminum alloys. Accordingly, using the apparatus and method of the present invention, it is now generally possible to predict with excellent accuracy how thick the resulting oxide coating on the workpiece will be when the workpiece is subjected to a predetermined sequence of anodizing process steps of specified voltages and currents in a controlled electrolyte bath.

In experiments with the apparatus of the present invention, we have also found that using longer times between successive pulses of positive currnet ($I_p$) is beneficial, in that thicker anodic coatings may be achieved. This may be done, for example, by disabling one of the SCRs, like SCR 94 such as by open circuiting one or more of the conductors leading thereto, so that the total time between successive pulses is approximately doubled. In this situation, forward current pulses from power supply 12 connected to a 60 Hz AC power source 14 are delivered at 60 Hz rate rather than the usual 120 Hz rate when both SCRs 92 and 94 are operating. We have found that thicker coatings are produced when using one SCR by approximately doubling the power used to drive the one remaining SCR, so that the average current emanating from power supply 12 remains at about the same level as when two SCRs are used.

As noted earlier above, a number of other prior art processes also employed negative currents, which may have tended to begin discharging the stored charge present across the anode and cathode of the anodizing cell. However, we note that none of these processes apparently relied solely upon the stored charge discharging itself through an external very low impedance shunt path in parallel with the anodizing cell. Instead, these prior art systems and processes appear to employ a negative voltage source either to forcefully discharge the inherent capacitance just before the next positive current pulse, or to limit the rate of discharging to relatively modest negative current flows.

In contrast to this prior art, we have found it very beneficial not to employ any negative voltage to discharge the inherent capacitance, but instead to allow the charge stored across the inherent capacitance to discharge itself in a rapid manner. This completely avoids two problems present in the earlier anodizing systems employing negative current to the workpiece. First, it is known that excessive forced negative current upon a part or workpiece being anodized is detrimental. Specifically, once the inherent capacitance of the anodizing cell is fully discharged, any further negative current unnecessarily applies a negative bias to the anodizing cell that has to be removed by the next positive current pulse before anodizing conditions can be reestablished in the cell, which wastes power and causes unnecessary heating of the part and bath. Also, if the negative current builds to a sufficiently high negative bias on the anodizing cell, it may begin to erode the oxide coating or produce other harmful effects. Second, these prior art anodizing systems apparently require continual and fairly complex monitoring and adjustment of the power control units, which we believe may be necessary at least in part in order to avoid the just-mentioned drawbacks associated with negative current.

Our invention inherently avoids the aforementioned two problems because of aforementioned excessive negative current conditions cannot be produced using the power control apparatus of the present invention, and because the capacitive discharge apparatus and method of the present invention is believed significantly simpler to operate. Ramping is not required, and fewer power adjustments may be made during the anodizing cycle. Moreover, the pulsed DC power supply 12 does not need to be continually monitored and adjusted during the anodizing cycle to prevent detrimental effects like burning and dissolution. Also, the automatic capacitive discharge unit 16 does not need to be adjusted at all during the anodizing cycle.

Another important aspect of the present invention is that the automatic capacitive discharge unit 16 quickly discharges the inherent capacitance as soon as positive current is no longer flowing into the workpiece. We have found that best results are achieved when the inherent capacitance is discharged very rapidly, so that the workpiece being anodized is in a substantially discharged state for the longest possible period of time between successive pulses of positive current from the power supply unit 12. In the anodizing system and method described in aforementioned U.S. patent application Ser. No. 943,510, considerations of power consumption limit how low the impedance of the continuously connected shunt discharge means may practically be made. This is because as impedance of the shunt discharge means in that system is reduced, the amount of electrical power wasted through the shunt increased correspondingly. In contrast in the present invention, by automatically switching the discharge shunt 66 out of the anodizing circuit when positive current is flowing, the power control apparatus 11 can utilize a shunt element 66 with extremely low impedance without wasting any energy. In fact, the element 66 may be replaced by a conductor having essentially zero ohms impedance if the power switching device 64 and other electrical conductors and connections in the anodizing system are sized to handle the resulting discharge current surges whenever the switching device 64 is turned on. As those skilled in the electrical design of aluminum anodizing systems will readily appreciate, negative current is limited in such instances only by the combined impedance of the anodizing cell 10, the power conductors and electrical connections through which the current passes, and the switching device 64. In an alternate embodiment of the present invention, the amount of discharge current could also be controlled by using one or more suitably sized power transistors or like devices and regulating their transconductance, i.e. how hard they are turned on, by a suitable analog input signal generally proportional to the desired discharge current.

Figure 3E:
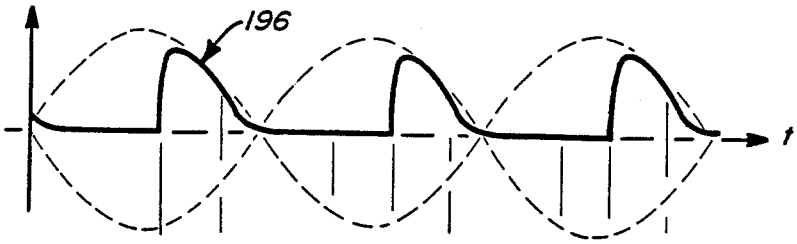
Figure 3F:
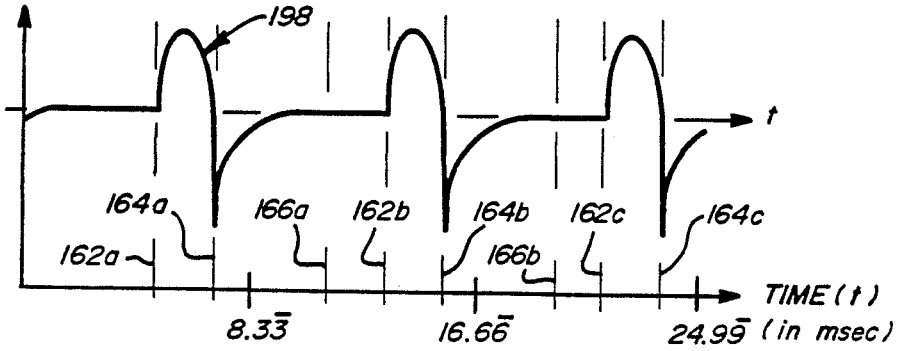

Our tests show that the best anodizing results, in terms of rate of oxide formation per unit input energy and quality of the oxide coating, are often produced by discharging the charge stored across the inherent capacitance as quickly as possible immediately after the cessation of positive current flowing to the workpiece. For example, with a current limiter 66 that has a suitable low impedance, the rate of discharge of the cell 10 can easily exceed the rate of charging of the cell 10. Preferably, the impedance of the current-limiting element in the shunt discharge path should at least be low enough to permit discharging of the inherent capacitance so that the voltage thereacross is reduced to no more than 2% of its original value before the next pulse of positive current flows into the workpiece again during a typical repetitive cycle of the anodizing cycle. Better yet, the current-limiting impedance of the discharge circuit should be sized low enough to permit voltage across the inherent capacitance to drop to about one-eighth of its original value in a timer period not greater than one-sixth of the predetermined frequency of the AC power source. This relationship is satisfied for example by the discharging rate illustrated by waveform 150 and 160 in FIGS. 3A and 3B. Finally, as previously mentioned, the rate of discharging can be increased to occur in less time than in required to charge the inherent capacitance. The relationship is illustrated by the voltage and current waveform 196 and 198 of FIGS. 3E and 3F. Note that in the method illustrated by waveforms 196 and 198, the current-limiting means of the automatic discharge unit 16 is sized to discharge the accumulated charge present on the anodizing cell sufficiently quickly so that the voltage across the inherent capacitance drops to about one-eighth of its original value in a time period not greater than one-sixth of the period of the predetermined frequency of the AC power source. This last method of operation typified by the wave forms shown in FIGS. 3E and 3F provides the largest amount of time for the workpiece to soak in the electrolyte in its discharged state between successive pulses of positive current. The exact value of impedance of the current limiter 66 required to achieve such a rapid discharge rate can easily be determined by calculation or experimentation by those skilled in the art for any given anodizing cell 10 and power control apparatus 11.

The results of our test with the present invention suggest that the power control apparatus and method of the present invention can be adapted to almost any aluminum or aluminum alloy anodizing process. For example, the present invention can be used with a 22 percent sulfuric acid bath maintained at 30 degrees F. to achieve a 2 mil (e.g., 0.002 inch) coating on aluminum parts such as aluminum alloy 6061 in ten five minute steps with a maximum average voltage of less than 31 volts DC between anode and cathode as described in Example II of the aforementioned U.S. patent application Ser. No. 943,510. in that example, the average voltage starts out at 14.5 volts DC during the first time increment and is gradually increased with each successive time increment as the oxide coating builds. During the tenth time increment, the average voltage is at 30.6 volts DC. By way of contrast, the average DC voltage used to hard-coat anodize the same kind of part without using a shunt discharge means typically starts near zero volt during the first five-minute time increment and typically ends up at around 70 or 75 volts DC by the final (twelfth) five minute increment, as decribed in Example IV of the aforementioned application.

The foregoing detailed description shows that the preferred embodiments of the present invention are well-suited to fulfill the objects above stated. It is recognized that those in the art may make various modifications or additions to the preferred embodiments chosen to illustrate the present invention without departing from the spirit and the proper scope of the present invention. For example, the automatic capacitive discharge function of the present invention may be adapted to work with three-phase AC-to-DC power supplies. Also, we believe the present invention may be used in aluminum anodizing processes which employ chromic acid baths or which operate at any one of several temperatures, i.e., below, at or above room temperature. Those in the art will readily appreciate that multiple workpieces placed on conventional or suitable anodizing racks or fixtures may be processed simultaneously in a common bath using the power control apparatus used in the system and method of the present invention. Accordingly, it is to be understood that the protection sought and to be afforded hereby should be deemed to extend to the subject matter defined by the appended claims, including all fair equivalents thereof.

We claim:

1. In an anodizing system using an electrolyte, anode and cathode, for anodizing at least one workpiece of aluminum or alloys thereof in liquid bath including the electrolyte, an improved electrical power control apparatus for providing positive and negative current to the workpiece during the anodizing process, the improvement comprising in combination:

power supply means for intermittently providing only positive current to the workpiece during the anodizing process; and automatic switchable shunt discharge means for intermittently providing negative current to the workpiece by shunting the anode to the cathode, the discharge means being arranged to produce such negative current solely by the unassisted discharge of accumulated charge present on any inherent capacitance existing between the anode and workpiece being anodized and the electrolyte and cathode.

2. The apparatus of claim 1 wherein the switchable shunt discharge means includes at least one electrical switching device switchable between a very low impedance conducting state and a high impedance non-conducting state, and control means for determining when to switch the electrical switching device between its conducting and non-conducting states based at least in part upon whether the power supply means is providing positive current to the workpiece.

3. The apparatus system of claim 2, wherein the control means includes:

first sensing means for detecting when the power supply means is no longer providing positive current to the workpiece, said first sensing means being automatically responsive to changes in the amount of accumulated charge present on the inherent capacitance.

4. The apparatus of claim 3, wherein said sensing means includes electrical isolation means responsive to changing current for detecting the approximate cessation of positive current flow into the workpiece, the electrical isolation means including a current transformer.

5. The apparatus of claim 3, wherein the control means includes:

second sensing means for detecting when the power supply means is beginning to provide positive current to the workpiece, said second means including at least one electrical isolation means for responding to an electric signal produced by the power supply means, memory means responsive to the first and second sensing means for remembering when the power supply means is providing positive current to the workpiece, and interlock means for switching the electrical switching device to its non-conducting state whenever the power supply means is providing positive current to the workpiece.

6. The apparatus of claim 2, wherein the control means includes timing means for determining when the power supply means has not supplied positive current to the workpiece for a predetermined length of time, and shut-off means to switch the electrical switching device to is non-conducting state when such timing means indicates that positive current has not been provided to the workpiece for at least the predetermined length of time.

7. The apparatus of claim 1, wherein:

the power supply means includes AC-to-DC power conversion means connectrable to a source of AC power having a predetermined frequency for providing pulsed DC power, said power conversion means including at least one triggerable power switching device to provide intermittent positive current to the worpiece at the predetermined frequency, and the switchable shunt discharge means is arranged to provide negative current to the workpiece immediately after cessation of positive current provided by the power supply means.

8. The apparatus as in claim 7, wherein:

the shunt discharge means includes current-limiting means for limiting the negative current to a predetermined maximum value, the current-limiting means being sized to permit substantially complete discharge of any accumulated charge present on the inherent capacitance before the power supply means provides positive current again.

9. The apparatus of claim 8, wherein the current-limiting means is sized to discharge the accumulated charge present on the inherent capacitance sufficiently quickly so that the voltage across the inherent capacitance drops to about one-eighth of its original value in a time period not greater than one-sixth of the period of the predetermined frequency of the AC power source.

10. The apparatus of claim 8, wherein the current-limiting means is sized to discharge the accumulated charge present on the inherent capacitance sufficiently quickly so that the voltage across the inherent capacitance drops to about one-eighth of its original value in a time period not greater than one-sixth of the period of the predetermined frequency of the AC power source.

11. In an anodizing system using an electrolyte, anode and cathoe, for anodizing at least one workpiece of aluminum or alloys thereof in liquid bath including the electrolyte, a method of controllably discharging any inherent capacitance existing between the anode and workpiece being anodized and the electrolyte and cathode during an anodizing process involving the intermittent supplying of positive current from the anode into the workpiece, the method comprising the steps of:

(a) providing automatic switchable shunt discharge means for intermittently providing negative current to the workpiece by shunting the anode to the cathode, the discharge means being arranged to produce such negative current solely by the unassisted discharge of accumulated charge present on the inherent capacitance;

(b) detecting the cessation of positive current flow into the workpiece; and (c) immediately after detecting such cessation of the positive current flow, providing such negative current in an amount sufficient to discharge the inherent capacitance substantially completely prior to the next intermittent supplying of positive current from the anode into the workpiece.

12. The method of claim 11, further comprising the steps of:

(d) providing a current limiting element in the shunt discharge means whose impedance is sufficiently low to permit discharging of the inherent capacitance so that the voltage thereacross is reduced to no more than 2% of its original value before positive current flows into the workpiece again during the anodizing process.

13. The method of claim 12, further comprising the steps of:

(e) sensing approximately when positive current begins to flow into the workpiece;

(f) sensing approximately when positive current stops flowing into the workpiece; and (g) inhibiting the providing of negative current by the shunt discharge means for a period of time between the sensed beginning of the flow of positive current and the next sensed stopping of the flow of positive current wherein the intermittent supplying of positive current occurs at a predetermined frequency.

14. The method of claim 13, further comprising the steps of:

(h) determining when the time between sensed beginnings of successive intervals of positive current flows exceeds a predetermined length of time at least twice as long as the period of the predetermined frequency; and (i) inhibiting the providing of negative current by the shunt discharge means when positive current flow has not been produced for at least the predetermined length of time.

* * * * *